US007705694B2

(12) United States Patent
Craig et al.

(10) Patent No.: US 7,705,694 B2
(45) Date of Patent: Apr. 27, 2010

(54) ROTATABLE ELLIPTICAL DIELECTRIC RESONATORS AND CIRCUITS WITH SUCH DIELECTRIC RESONATORS

(75) Inventors: Neil James Craig, Nashua, NH (US); Paul John Schwab, Nashua, NH (US); Kristi Dhimiter Pance, Auburndale, MA (US)

(73) Assignee: Cobham Defense Electronic Systems Corporation, Bolton, MA (US)

( * ) Notice: Subject to any disclaimer, the term of this patent is extended or adjusted under 35 U.S.C. 154(b) by 244 days.

(21) Appl. No.: 11/330,846

(22) Filed: Jan. 12, 2006

(65) Prior Publication Data

US 2007/0159275 A1 Jul. 12, 2007

(51) Int. Cl.
*H01P 1/20* (2006.01)
*H01P 7/10* (2006.01)

(52) U.S. Cl. ..... 333/202; 333/219.1; 333/235

(58) Field of Classification Search ..... 333/202, 333/219.1, 212, 235
See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | 333/73 W |
| 4,138,652 | A | 2/1979 | Nishikawa et al. | 333/82 R |
| 4,267,537 | A | 5/1981 | Karmel | 333/231 |
| 4,283,649 | A | 8/1981 | Heinouchi | 310/324 |
| 4,423,397 | A | 12/1983 | Nishikawa et al. | 333/202 |
| 4,459,570 | A | 7/1984 | Delaballe et al. | 333/202 |
| 4,477,785 | A | 10/1984 | Atia | 333/202 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | 333/202 |
| 4,821,006 | A | 4/1989 | Ishikawa et al. | 333/202 |

(Continued)

FOREIGN PATENT DOCUMENTS

EP 0 492 304 A1 7/1992

(Continued)

OTHER PUBLICATIONS

Tadjalli et al., "Modes of Elliptical Cylinder Dielectric Resonator and its Resonant Frequencies," IEEE Antennas & Propagation Society International Symposium, vol. 2, Jun. 20-25, 2004, pp. 2039-2042.*

(Continued)

*Primary Examiner*—Benny Lee
(74) *Attorney, Agent, or Firm*—Jaeckle Fleischmann & Mugel, LLP

(57) ABSTRACT

In accordance with principles of the present invention, a two or more pole dielectric resonator circuit is provided with resonators that are elliptical in cross section orthogonal to the longitudinal axis. The resonators are mounted so that they are rotatable about their longitudinal axes, such that the straight line distance between two adjacent resonators measured in a straight line between orthogonal to and intersecting the longitudinal axes of the two resonators is a function of the orientation of the resonators about their longitudinal axes. The resonators can be oriented about their longitudinal axes in any orientation to adjust their spacing, which is directly proportional to their coupling magnitude, which, in turn, is proportional to the bandwidth of the circuit.

6 Claims, 3 Drawing Sheets

U.S. PATENT DOCUMENTS

| | | | | |
|---|---|---|---|---|
| 4,835,498 | A | 5/1989 | Rouger et al. | 333/205 |
| 4,881,051 | A | 11/1989 | Tang et al. | 333/208 |
| 5,059,929 | A | 10/1991 | Tanaka | 333/219.1 |
| 5,109,207 | A | 4/1992 | Aizawa et al. | 333/222 |
| 5,140,285 | A | 8/1992 | Cohen | 331/96 |
| 5,218,330 | A | 6/1993 | Omiya et al. | 333/223 |
| 5,347,246 | A | 9/1994 | Bellows et al. | 333/219 |
| 5,525,945 | A | 6/1996 | Chiappetta et al. | 333/202 |
| 5,614,875 | A | 3/1997 | Jang et al. | 333/202 |
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,841,330 | A | 11/1998 | Wenzel et al. | 333/202 |
| 5,859,574 | A | 1/1999 | Schmitt | 333/202 |
| 5,874,922 | A * | 2/1999 | Tanaka | 343/753 |
| 5,949,309 | A | 9/1999 | Correa | 333/202 |
| 5,990,767 | A | 11/1999 | Ivanov et al. | 333/219.1 |
| 6,087,910 | A | 7/2000 | Matsumoto et al. | 333/202 |
| 6,100,703 | A | 8/2000 | Davidov et al. | 324/631 |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | 156/89.12 |
| 6,262,639 | B1 | 7/2001 | Shu et al. | 333/202 |
| 6,337,664 | B1 | 1/2002 | Mayes et al. | 343/749 |
| 6,402,981 | B1 | 6/2002 | Sasaki | 252/62.9 PZ |
| 6,597,264 | B2 * | 7/2003 | Barba Gea et al. | 333/202 |
| 6,707,353 | B1 | 3/2004 | Yamakawa et al. | 333/202 |
| 6,717,490 | B1 | 4/2004 | Mayer | 333/202 |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |

FOREIGN PATENT DOCUMENTS

| | | | |
|---|---|---|---|
| EP | 0 601 370 | A1 | 6/1994 |
| EP | 1 162 684 | A2 | 12/2001 |
| EP | 1 181 740 | B1 | 3/2003 |
| GB | 1 376 938 | | 12/1974 |
| GB | 1 520 473 | | 8/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05095214 | A * | 4/1993 |
| JP | 05-267940 | | 10/1993 |
| JP | 06-061714 | | 3/1994 |
| JP | 07-154114 | A | 6/1995 |
| JP | 07-154116 | | 6/1995 |
| JP | 03-249803 | | 9/2003 |
| WO | WO 00/70706 | | 11/2000 |
| WO | WO 01/43221 | | 6/2001 |
| WO | WO 2004/027917 | A2 | 4/2004 |
| WO | WO 2004/027917 | A3 | 4/2004 |

OTHER PUBLICATIONS

Chair et al., "Wideband Low Profile Eye Shaped Dielectric Resonator Antennas", , IEEE Antennas & Propagation Society International Symposium, vol. 3A, Jul. 3-8, 2005, pp. 582-585.*

Hui et al. "Dielectric Ring-Gap Resonator for Application in MMIC's" IEEE Transactions on Microwave Theory and Techniques vol. 39, No. 12, Nov. 1991.

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

J. S. Hersch et al., "Observation of Proximity Resonances in a Parallel-Plate Waveguide", Physical Review Letters, vol. 81, No. 15, Oct. 12, 1998, The American Physical Society, pp. 3059-3062.

M. A. Gerdine, "A Frequency-Stabilized Microwave Band-Rejection Filter Using Filter Using High Dielectric Constant Resonators", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{01\delta}$ Dielectric Resonator Modes" Electronics Letters, May 25, 1989, vol. 25 No. 11, pp. 693-694.

Kishk et al., "Conical Dielectric Resonator Antennas for Wide-Band Applications", IEEE Transactions on Antennas and Propagation, 50(4); 469-474 (2002).

Nishikawa et al., "Dielectric High-Power Bandpass Filter Using Quarter-Cut $TE_{01\delta}$ Image Resonator for Cellular Base Stations", IEEE Transactions on Microwave Theory and Techniques, vol. MTT-35, No. 12, Dec. 1987.

* cited by examiner

ROTATABLE ELLIPTICAL DIELECTRIC RESONATORS AND CIRCUITS WITH SUCH DIELECTRIC RESONATORS

FIELD OF THE INVENTION

The invention pertains to dielectric resonators, such as those used in microwave circuits for concentrating electric fields, and to the circuits made from them, such as microwave filters.

BACKGROUND OF THE INVENTION

Dielectric resonators are used in many circuits for concentrating electric fields. For instance, they are commonly used as filters in high frequency wireless communication systems, such as satellite and cellular communication applications. They can be used to form oscillators, triplexers and other circuits, in addition to filters. Combline filters are another well known type of circuit used in front-end transmit/receive filters and diplexers of communication systems such as Personal Communication System (PCS), and Global System for Mobile communications (GSM). The combline filters are configured to pass only certain frequency bands of electromagnetic waves as needed by the communication systems.

FIG. 1 is a perspective view of a typical dielectric resonator of conventional design. As can be seen, the resonator 10 is formed as a cylinder 12 of dielectric material with a circular, longitudinal through hole 14. FIG. 2 is a perspective view of a microwave dielectric resonator filter 20 of the prior art employing a plurality of dielectric resonators 10*a*, 10*b*, 10*c*, 10*d*. The resonators 10*a*, 10*b*, 10*c*, 10*d* are arranged in the cavity 22 of a conductive enclosure 24. The conductive enclosure 24 typically is rectangular. The enclosure 24 commonly is formed of aluminum and is silver-plated, but other materials also are well known. The resonators 10*a*, 10*b*, 10*c*, 10*d* may be attached to the floor 44 of the enclosure, such as by an adhesive, but also may be suspended above the floor of the enclosure by a low-loss dielectric support, such as a post or rod.

Microwave energy is introduced into the cavity by an input coupler 28 coupled to an input energy source through a conductive medium, such as a coaxial cable. Signals also may be coupled into (and out of) a dielectric resonator circuit by other techniques, such as microstrips positioned on the bottom surface of the enclosure 24 adjacent the resonators.

That energy is electromagnetically coupled between the input coupler and the first dielectric resonator. Coupling may be electric, magnetic, or both. Conductive separating walls 32*a*, 32*b*, 32*c*, 32*d* separate the resonators from each other and block (partially or wholly) coupling between physically adjacent resonators 10*a*, 10*b*, 10*c*, 10*d*. Particularly, irises 30*a*, 30*b*, 30*c* in walls 32 control the coupling between adjacent resonators 10*a*, 10*b*, 10*c*, 10*d*. Walls without irises generally prevent any coupling between adjacent resonators separated by those walls. Walls with irises allow some coupling between adjacent resonators separated by those walls. By way of example, the dielectric resonators 10*a*, 10*b*, 10*c*, 10*d* in FIG. 2 electromagnetically couple to each other sequentially, i.e., the energy from input coupler 28 couples into resonator 10*a*, resonator 10*a* electromagnetically couples with the sequentially next resonator 10*b* through iris 30*a*, resonator 10*b* couples with the sequentially next resonator 10*c* through iris 30*b*, and so on until the energy is coupled to the sequentially last resonator 10*d*. An output coupler 40 is positioned adjacent the last resonator 10*d* to couple the microwave energy out of the filter 20. Wall 32*a*, which does not have an iris, prevents the field of resonator 10*a* from coupling with physically adjacent, but not sequentially adjacent, resonator 10*d* on the other side of the wall 32*a*.

Generally, both the bandwidth and the center frequency of the filter must be set very precisely. Bandwidth is dictated by the magnitude of coupling between the dielectric resonators and, therefore, is primarily a function of (a) the spacing between the individual dielectric resonators 10*a*, 10*b*, 10*c*, 10*d* of the circuit and (b) the metal between the dielectric resonators (i.e., the size and shape of the housing 24, the walls 32*a*, 32*b*, 32*c*, 32*d* and the irises 30*a*, 30*b*, 30*c* in those walls, as well as any tuning screws placed between the dielectric resonators as discussed below). The coupling between adjacent resonators is directly proportional to the distance between them.

The center frequency of a dielectric resonator circuit, on the other hand, is primarily a function of the characteristics of the individual dielectric resonators themselves, such as the dielectric constants of the resonators, the size of the individual dielectric resonators, and the metal adjacent the individual resonators (i.e., the housing and the tuning plates 42 discussed immediately below).

Initial frequency and bandwidth tuning of these circuits is done by selecting a particular size for the resonators, a particular size and shape for the housing (including selection of the separating walls and irises), and a particular spacing between the individual resonators. This is a very difficult process that is largely performed by trial and error. Accordingly, it can be extremely laborious and costly. Particularly, each iteration of the trial and error process requires that the filter circuit be returned to a machine shop for re-machining of the cavity, irises, and/or tuning elements (e.g., tuning plates and tuning screws) to new dimensions. In addition, the tuning process involves very small and/or precise adjustments in the sizes and shapes of the resonators, housing, irises, tuning plates, tuning screws, and cavity. Thus, the machining process itself is expensive and error-prone.

Furthermore, generally, a different housing design must be developed and manufactured for every circuit having a different frequency. Once the housing and initial design of the circuit is established, then it is often necessary or desirable to provide the capability to perform fine tuning of the frequency.

In order to permit fine tuning of the center frequency of such circuits after the basic design is developed, one or more metal tuning plates 42 may be attached to a top cover plate (the top cover plate is see-through in FIG. 2 in order not to obfuscate the invention) generally coaxially with a corresponding resonator 10*a*, 10*b*, 10*c*, 10*d* to affect the field of the resonator (and particularly the parasitic capacitance experienced by the resonator) in order to help set the center frequency of the filter. Particularly, plate 42 may be mounted on a screw 43 passing through a threaded hole in the top cover plate (not seen in FIG. 2) of enclosure 24. The screw may be rotated to vary the distance between the plate 42 and the respective resonator 10*a*, 10*b*, 10*c*, or 10*d* to adjust the center frequency of the resonator.

This is a purely mechanical process that also tends to be performed by trial and error, i.e., by moving the tuning plates and then measuring the frequency of the circuit. This process also can be extremely laborious since each individual dielectric resonator and accompanying tuning plate must be individually adjusted and the resulting response measured.

Mechanisms also often are provided to fine tune the bandwidth of a dielectric resonator circuit after the basic design has been selected. Such mechanisms often comprise tuning screws positioned in the irises between the adjacent resonators to affect the coupling between the resonators. The tuning screws can be rotated within threaded holes in the housing to increase or decrease the amount of conductor (e.g., metal) between adjacent resonators in order to affect the capacitance between the two adjacent resonators and, therefore, the coupling therebetween. In fact, it generally is a design goal to space the resonators far enough away from each other that there is no direct coupling between electrically adjacent resonators, but only through the iris walls and tuning screws.

The walls within which the irises are formed, the tuning plates, the tuning screws, and even the cavity all create losses in the system, thereby decreasing the quality factor, Q, of the system and increasing the insertion loss of the system. Q essentially is an efficiency rating of the system and, more particularly, is the ratio of stored energy to lost energy in the system. The portions of the fields generated by the dielectric resonators that exist outside of the dielectric resonators touch all of the conductive components of the system, such as the enclosure 20, tuning plates 42, internal walls 32*a*, 32*b*, 32*c*, 32*d*, and any tuning screws (not shown in FIG. 1) and inherently generate currents in those conductive elements. Field singularities exist at any sharp corners or edges of conductive components that exist in the electromagnetic fields of the filter. Any such singularities increase the insertion loss of the system, i.e., reduce the Q of the system. Thus, although the iris walls, tuning screws, and tuning plates serve an important function, they are the cause of loss of energy within the system.

Another disadvantage of the use of tuning screws within the irises is that such a technique does not permit significant changes in coupling strength between the dielectric resonators. Tuning screws typically provide tunability of not much more than 1 or 2 percent change in bandwidth in a typical communication application, where the bandwidth of the signal is commonly about 1 percent of the carrier frequency. For example, it is not uncommon in a wireless communication system to have a 20 MHz bandwidth signal carried on a 2000 MHz carrier. It would be very difficult using tuning screws to adjust the bandwidth of the signal to much greater than 21 or 22 MHz.

As is well known in the art, dielectric resonators and dielectric resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is normally the transverse electric field mode, $TE_{01}$ (or TE hereinafter). Typically, the fundamental TE mode is the desired mode of the circuit or system in which the resonator is incorporated. The second-lowest-frequency mode typically is the hybrid mode, $H_{11}$ (or $H_{11}$ hereinafter). The $H_{11}$ mode is excited from the dielectric resonator, but a considerable amount of electric field lies outside of the resonator and, therefore, is strongly affected by the cavity. The $H_{11}$ mode is the result of an interaction of the dielectric resonator and the cavity within which it is positioned (i.e., the enclosure) and has two polarizations. The $H_{11}$ mode field is orthogonal to the TE mode field. Some dielectric resonator circuits are designed so that the $H_{11}$ mode is the fundamental mode. For instance, in dual mode filters, in which there are two signals at different frequencies, it is known to utilize the two polarizations of the $H_{11}$ mode for the two signals.

There are additional higher order modes, including the $TM_{01}$ mode, but they are rarely, if ever, used and essentially constitute interference. Typically, all of the modes other than the TE mode (or $H_{11}$ mode in filters that utilize that mode) are undesired and constitute interference.

SUMMARY OF THE INVENTION

Accordingly, it is an object of the present invention to provide improved dielectric resonators.

It is another object of the present invention to provide improved dielectric resonator circuits.

It is a further object of the present invention to provide dielectric resonator circuits with increased tuning range.

It is one more object of the present invention to provide dielectric resonator circuits that are easy to tune.

In accordance with principles of the present invention, a two or more pole dielectric resonator circuit is provided with resonator bodies that are elliptical in cross section orthogonal to the longitudinal axis, i.e., the radial dimension. In other words, the resonator looks elliptical when looking at it down the longitudinal axis. These resonators are mounted so that they are rotatable about their longitudinal axes, such that the straight line minimum distance between two adjacent resonators is a function of the orientation of the resonators about their longitudinal axes. In other words, minimum spacing between two resonators is achieved when the two resonators are oriented about their longitudinal axes such that their major cross-sectional axes are collinear. Maximum spacing is achieved when the two resonators are oriented such that the minor axes of the ellipses are collinear.

Each resonator can be oriented about their longitudinal axes in any orientation to adjust their spacing, which is directly proportional to their coupling magnitude, which, in turn, is proportional to the bandwidth of the circuit.

DETAILED DESCRIPTION OF THE INVENTION

Figure 1:
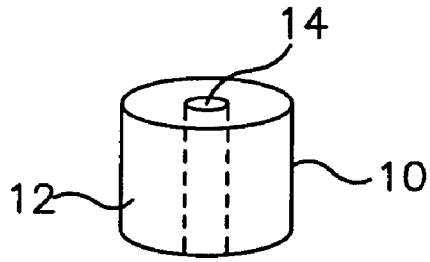
FIG. 1 PRIOR ART
FIG. 1 is a perspective view of an exemplary conventional cylindrical dielectric resonator.
Figure 2:
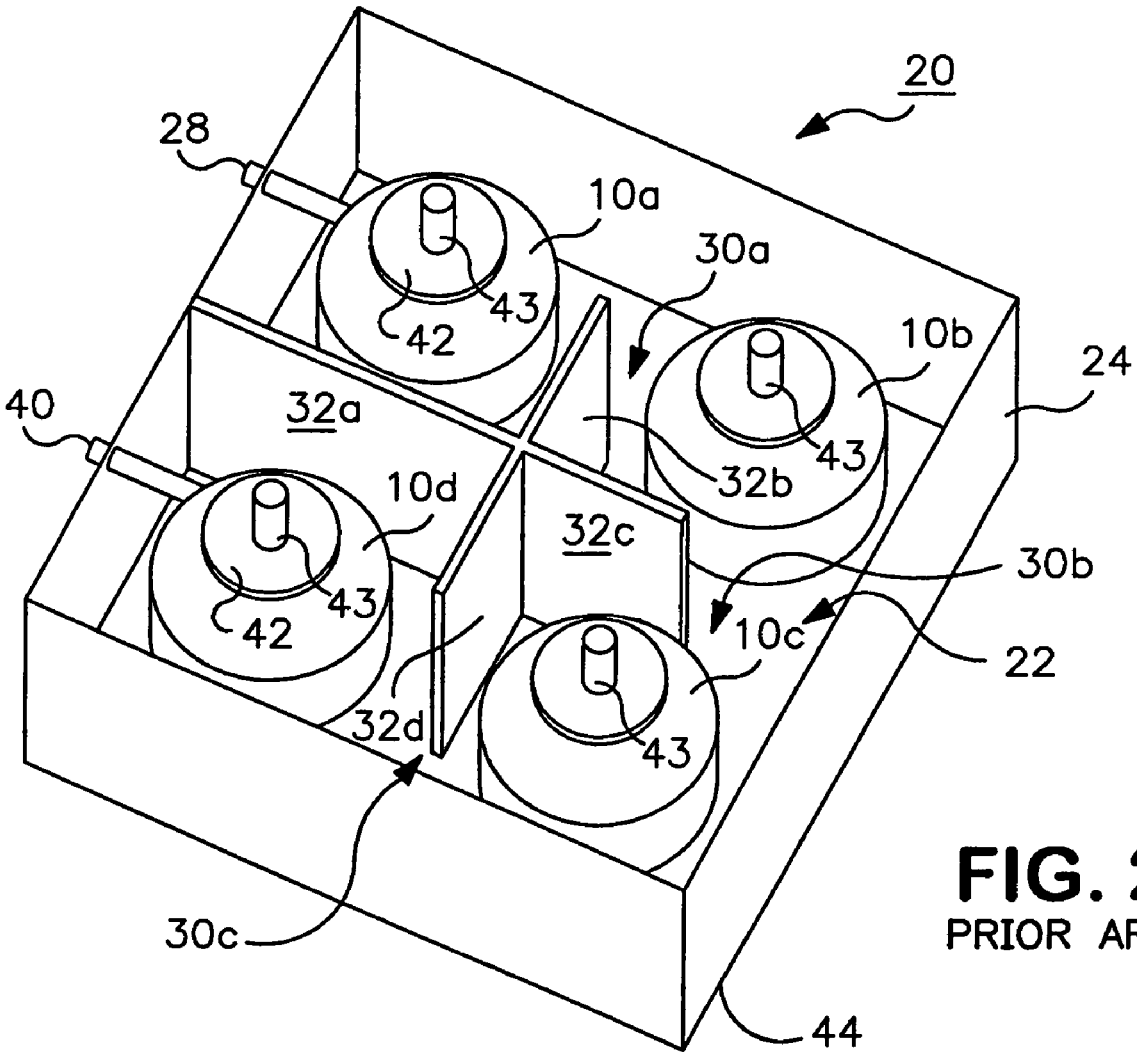
FIG. 2 PRIOR ART
FIG. 2 is a perspective view of an exemplary conventional microwave dielectric resonator filter circuit.
Figure 3:
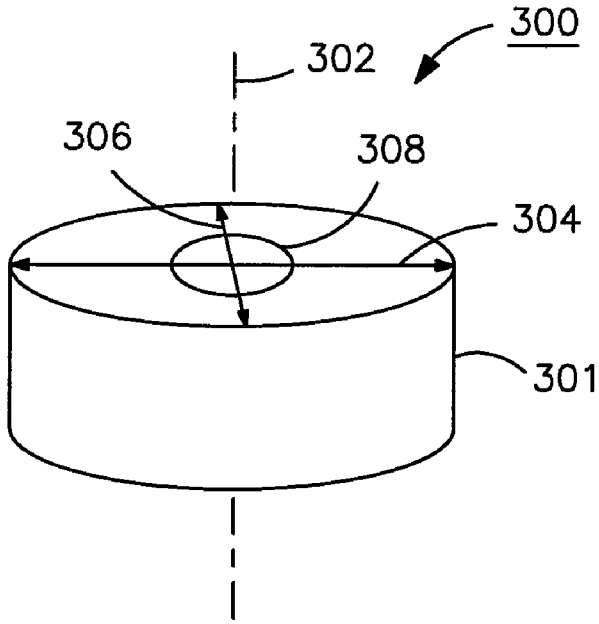
FIG. 3 is a perspective view of an elliptical resonator in accordance with the principles of the present invention.

FIG. 3 is a perspective view of a dielectric resonator 300 in accordance with a first embodiment of the present invention. The resonator body 301 essentially is elliptical in cross-section taken along a plane parallel to the field lines of the fundamental mode, i.e., perpendicular to the longitudinal axis 302 of the resonator body. The major axis of the ellipse is shown at 304 and the minor axis is shown at 306. As is common, a central longitudinal through hole 308 runs through the body 301.

Figure 4:
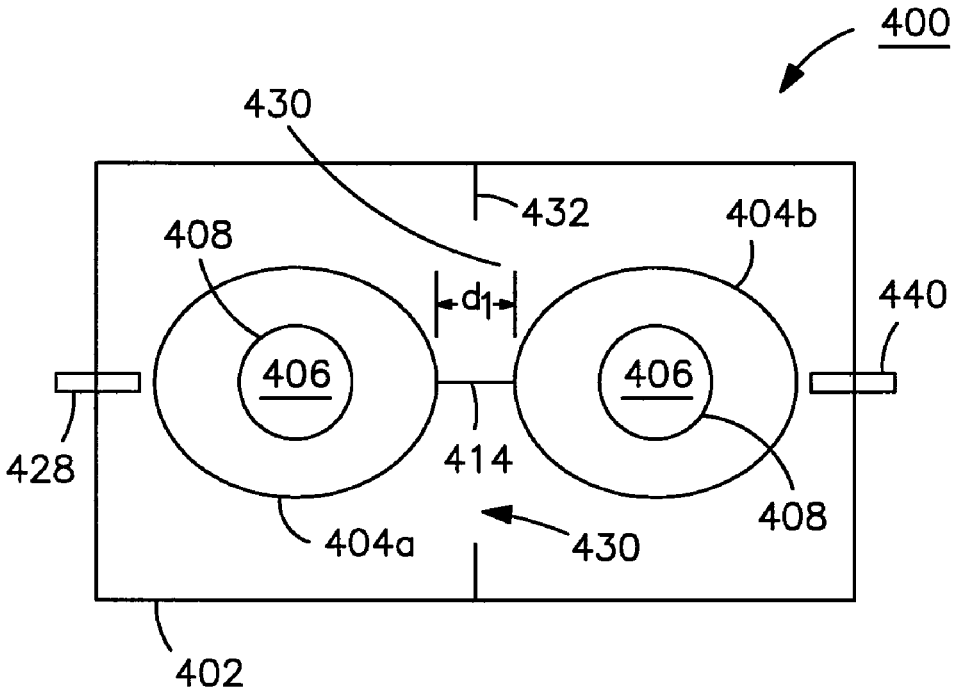
FIG. 4 is a plan view of a simple two pole dielectric resonator in accordance with the principles of the present invention.

FIG. 4 is a plan view of an exemplary two pole dielectric resonator circuit 400 employing two dielectric resonators 404*a* and 404*b* in accordance with the principles of the present invention. Other than the shapes of the resonators 404*a* and 404*b*, the circuit may be largely conventional. For instance, the housing 402 may be essentially conventional. For instance, microwave energy is introduced into the cavity by an input coupler 428 coupled to an energy source. A conductive separating wall 432 with an iris 430 therein is positioned between the two resonators 404*a* and 404*b*. An output coupler 440 is positioned adjacent the second resonator 404 to couple the microwave energy out of the circuit.

In a preferred embodiment, the resonators 404*a*, 404*b* are mounted to the housing 402 on posts (not shown) in the manner the resonators are mounted to the enclosure in U.S. Pat. No. 7,310,031 issued Dec. 18, 2007, which is fully incorporated herein by reference. The resonator is rotatably mounted on the post. Alternately or additionally, the post is rotatably mounted to the housing. The important feature is that the resonators can be rotated about their longitudinal axes. The actual mechanism by which the resonators are rotatable relative to the housing can take many forms. For instance, the longitudinal through holes 308 in the resonators may be internally threaded while the posts are matingly externally threaded such that the resonator is rotatable on the post. Alternately or additionally, the posts may be externally threaded and mounted within internally threaded holes in the housing 402.

In these particular embodiments, rotation of the resonator also affects a slight longitudinal movement of the resonator by the action of the mating threads. However, the longitudinal movement will be relatively small in relation to the change in rotational orientation of the resonators.

It should be apparent from FIG. 4 that rotation of the resonators 404*a* and 404*b* alters the spacing between the resonators. As previously mentioned, the magnitude of coupling between the two resonators (and, therefore, the bandwidth of the circuit) is highly dependent on the distance between the resonators. Specifically, let us consider the distance between the points on the surfaces of the two resonators closest to each other. In this particular embodiment, this will be the distance, $d_1$, between the external surfaces of the resonators measured along the line 414 perpendicular to the longitudinal axes of the resonators and connecting the longitudinal axes of the two resonators. As a practical matter, the magnitude of coupling between the two resonators is substantially linearly proportional to this distance $d_1$.

Thus, when the two resonators are oriented such that the major axes of their elliptical cross sections are collinear, the distance $d_1$ is the smallest it can be. On the other hand, when the two resonators are oriented such that the minor axes of their elliptical cross sections are collinear, the distance $d_1$ is the largest it can be. Thus, the bandwidth of the circuit will be the broadest when the major axes of the elliptical cross sections are collinear and, conversely, will be the narrowest when the minor axes of the elliptical cross-sections are collinear.

The coupling magnitude can be adjusted anywhere between these two extremes by relative rotation of the two resonators about their longitudinal axes.

In the embodiments described above in which the resonator is threadedly mounted on the post and/or the post is threadedly mounted in the housing, rotating the resonators relative to each other will also affect a change in the height of the resonators. This change in height also will alter the distance between the resonators and, therefore, the coupling magnitude. However, the change in coupling magnitude as a result of any relative changes in height between the two resonators will be minuscule compared to the change in coupling strength as a result of the change in rotation about the longitudinal axis. Furthermore, any change in coupling strength affected by the change in relative height of the resonators can be compensated for by slightly altering the orientation of the resonators about their longitudinal axes.

However, the resonators can be rotatably mounted about their longitudinal axes on posts by another mechanism that does not require a change in height associated with any change in orientation. For instance, the resonators may be mounted on posts, but with a friction fit between the resonator in the post, rather than a threaded fit. Alternately, any number of rotatable joints, including ball bearing joints and other types of bearing joints are well-known and can be employed.

Dielectric resonator circuits constructed in accordance with the principles of the present invention have many advantages over conventional dielectric resonator circuits. For instance, tuning can be accomplished solely in accordance with the principles of the present invention, thereby eliminating the need for tuning screws and the like, which lower the Q of the circuit. As will be seen in the examples discussed below, the present invention provides a much broader tunability than tuning screws, which can provide only about a 1% tuning range. However, tuning screws can still be used as an additional tuning mechanism in circuits employing the present invention.

As a result of the broad tunability provided by the present invention, the other component of the circuit need not be fabricated to as high tolerances as are required in the prior art. This includes the housing, the resonators, the separating walls and their irises, and the tuning screws. In fact, the irises in the separating walls may be dimensioned to a width that provides the broadest bandwidth and then the bandwidth can be tuned to a narrower bandwidth, if necessary, using the principles of the present invention. In fact, separating walls can be eliminated in their entirety, if desired. This may be particularly desirable in some circuits in order to increase the Q of the circuits. Specifically, as previously noted, all metal forming part of the housing results in energy losses to the circuit.

Furthermore, due to the increased breadth of tunability, a single housing design can be employed for different circuits that need to operate over more widely varying center frequencies, thus decreasing the need to design and fabricate a different housing for circuits that have to operate in different frequency bands.

Even furthermore, due to the extended tuning range provided by the present invention, circuits can be made with dielectric resonators formed of materials with higher dielectric constants than would be possible in the prior art. Particularly, as previously noted, it is essentially impossible to fabricate practical dielectric resonator circuits using dielectric resonators formed of materials with dielectric constants greater than about 45 because of the difficulty of tuning such circuits. However, with the increased tuning range provided by the present invention, higher dielectric constant materials can be employed.

Also, because of the increased tuning flexibility, the dielectric resonators can be moved closer to each other than might be permitted with a more conventional design, thus enabling even smaller circuits to be built.

Aforementioned U.S. Pat. No. 7,310,031 issued Dec. 18, 2007, discloses a new dielectric resonator as well as circuits using such resonators. A key feature of these new resonators is that the cross-sectional area of the resonator measured parallel to the field lines of the TE mode varies along the longitudinal direction of the resonator, i.e., perpendicularly to the TE mode field lines. In one embodiment, the cross-section varies monotonically as a function of the longitudinal dimension of the resonator, i.e., the cross-section of the resonator changes in only one direction (or remains the same) as a function of height. In a preferred embodiment, the resonator is conical. Preferably, the cone is a truncated cone. One of the primary advantages of the resonators and circuits disclosed in that patent application is that the field strength of the TE mode field outside of and adjacent the resonator varies along the longitudinal dimension of the resonator.

A dielectric resonator fabricated in accordance with the principles disclosed in the aforementioned patent application and also in accordance with the principles of the present invention, e.g., in the shape of an elliptical cone, particularly, a truncated cone has many advantages over conventional, cylindrical dielectric resonators, including physical separation of the $H_{11}$ mode from the TE mode and/or almost complete elimination of the $H_{11}$ mode. Specifically, the TE mode electric field tends to concentrate in the base of the resonator (the larger end) while the $H_{11}$ mode field tends to concentrate at the top (the narrower end) of the resonator. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and therefore strongly couple, whereas their respective $H_{11}$ mode fields remain further apart from each other and, therefore, do not couple to each other nearly as strongly, if at all. Accordingly, the $H_{11}$ mode would not couple to the adjacent microwave device nearly as much as in the prior art, where the TE mode and the $H_{11}$ mode are physically located much closer to each other.

In addition, the mode separation (i.e., frequency spacing between the modes) is increased in a conical resonator. Even further, the top of the resonator may be truncated to eliminate much of the portion of the resonator in which the $H_{11}$ mode field would be concentrated, thereby substantially attenuating the strength of the $H_{11}$ mode.

The present invention may also be applied to circuits employing resonators of the nature disclosed in the aforementioned patent application, e.g., conical resonators. Particularly, the conical resonators disclosed in the aforementioned patent application can be modified to have any elliptical cross section, rather than a circular cross-section, in a plane perpendicular to the longitudinal axis of the resonator.

The aforementioned application discloses that conical-type resonators can be mounted on threaded mounting posts. One of the advantages of this type of mounting of the resonators is the very fact that their spacing in the longitudinal direction can be altered by rotating the resonators on the posts and/or rotating the posts in the threaded holes in the housing. In the case of circuits employing conical resonators rather than more conventional cylindrical resonators, varying the spacing of the electrically adjacent resonators in the vertical direction actually has a significant impact on the coupling magnitude between the resonators. Hence, the principles of the present invention can be used in conjunction with conical resonators and both forms of tuning can be employed as complements to each other.

While the invention has been described in connection with resonators having elliptical cross sections, this is merely exemplary. Other shapes are possible, including non-perfect ellipses or any shape that is non-uniform in the direction orthogonal to the longitudinal axis of the resonator, i.e., the radial direction. Sharp corners should be avoided, if possible, since they cause field singularities.

Figure 5A:
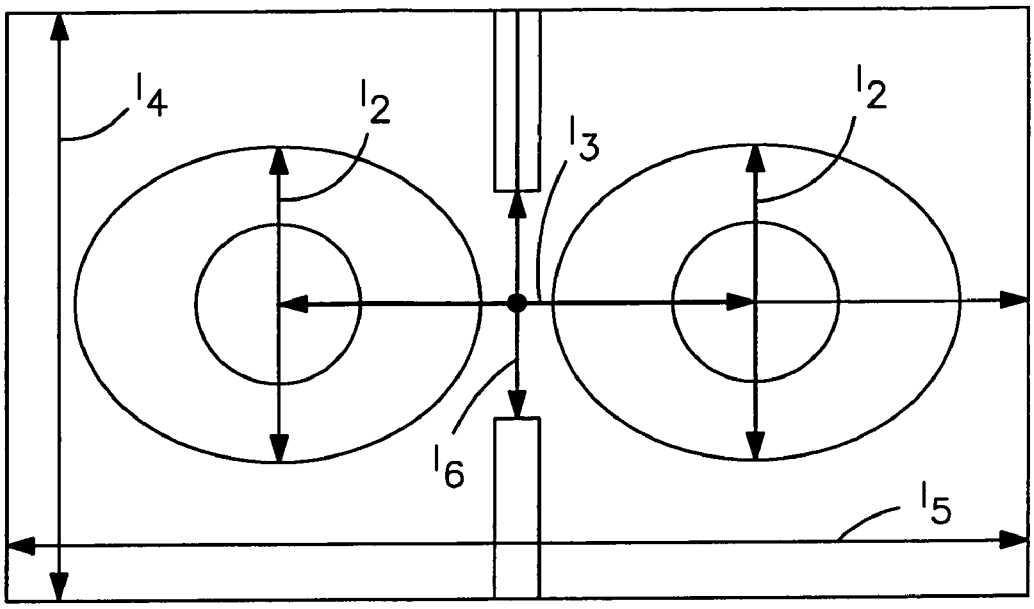
FIG. 5A is a plan view of an exemplary two pole dielectric resonator circuit employing elliptical resonators in accordance with the principles of the present invention in which the resonators are oriented with the minor axes of the ellipses collinear.
Figure 5B:
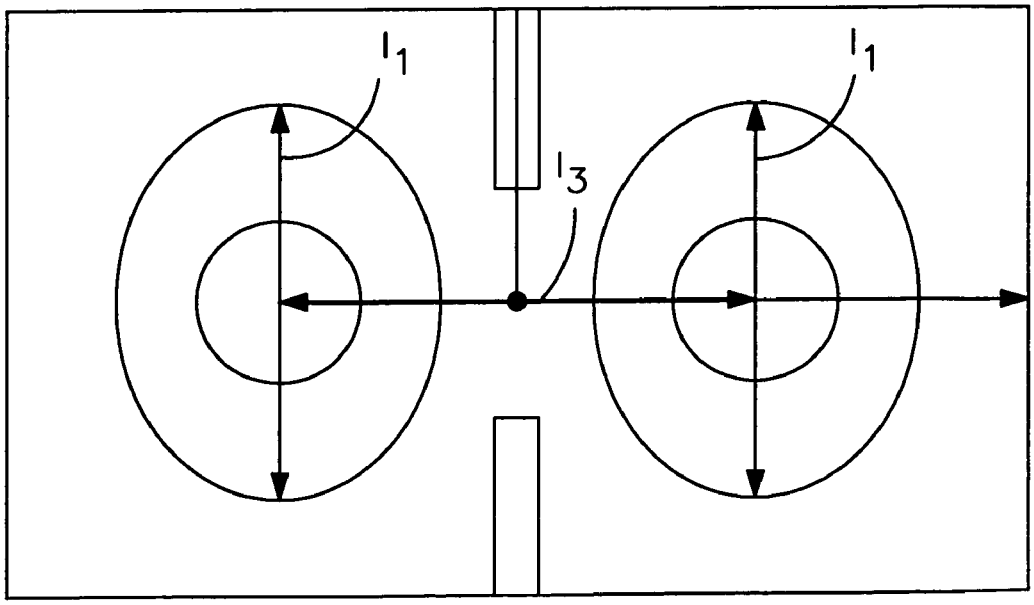
FIG. 5B is a plan view of the same two pole dielectric resonator circuit as in FIG. 5A, but with the resonators rotated 90° from the orientation illustrated in FIG. 5A such that the major axes of the ellipses are collinear.

Simulations show that very broad tuning ranges are possible employing the principles of the present invention. For example, FIGS. 5A and 5B are plan views of a two pole dielectric resonator filter employing the principles of the present invention. A computer simulation of this theoretical circuit was conducted using the following values:

Dielectric constant, $\in_r$=45
Major axis of ellipse, $I_1$=34 mm (FIG. 5B)
Minor axis of ellipse, $I_2$=27.4 mm (FIG. 5A)
Height=20 mm
Perpendicular distance between longitudinal axes of the two resonators, $I_3$=40 mm
Housing width, $I_4$=50 mm (FIG. 5A)
Housing length, $I_5$=86 mm (FIG. 5A)
Iris width, $I_6$=20 mm (FIG. 5A)
Excitation frequency=1.6 GHz With the resonators oriented with the major axes of the ellipses collinear as shown in FIG. 5A, i.e., the shortest possible distance between resonators (and hence the strongest possible coupling), the circuit has a bandwidth of 68 MHz.

With both dielectric resonators rotated 90° from the orientations shown in FIG. 5A so that the minor axes of the ellipses are collinear, as shown in FIG. 5B, i.e., the longest possible distance between resonators (and hence the weakest possible coupling), the circuit has a bandwidth of 51 MHz. Hence, in this particular example, the principles of the present invention provide a tunable range of 17 MHz. This is much broader than would be possible using merely a tuning screw positioned in the iris.

If we were to remove the iris completely, but otherwise keep the circuit identical, the tuning range would be 64 MHz to 72 MHz.

The concepts of the present invention can be employed in conjunction with the concepts of the present inventors' other patents and patent applications, including (1) the cross-coupling principles disclosed in U.S. patent application Ser. No. 10/268,480, (2) the principles for coupling energy to and from dielectric resonators disclosed in U.S. Pat. No. 6,784,768 issued Aug. 31, 2004, (3) the resonator mounting principles disclosed in U.S. Patent Application Publication No. 2004/0257176, (4) the tuning methods and apparatus disclosed in U.S. Patent Application Publication No. 2005/0200437, (5) the longitudinal through hole designs disclosed in U.S. Pat. No. 7,388,457, issued Jun. 17, 2008, (6) the electronic tuning methods and apparatus disclosed in U.S. Pat. No. 7,352,264, issued Apr. 1, 2008, (7) the resonators with axial gaps and/or stepped profiles and related circuits disclosed in U.S. Patent Application Publication No. 2007/0115080, (8) the resonator mounting mechanisms disclosed in U.S. Patent Application Publication No. 2004/0257176, and (9) the resonators and circuits disclosed in already mentioned U.S. Pat. No. 7,310,031, issued Dec. 18, 2007, all of which are fully incorporated herein by reference.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A method of tuning the bandwidth of a dielectric resonator circuit, said method comprising the steps of:

providing a dielectric resonator circuit comprising an enclosure, a plurality of dielectric resonators, each dielectric resonator comprising a body defining a longitudinal axis and a radial dimension orthogonal to said longitudinal axis, said bodies being non-uniform in the radial dimension and uniform in a direction of said longitudinal axis, an input coupler, and an output coupler, wherein said plurality of resonators are positioned relative to each other such that a field generated in each resonator couples to a field of another of said plurality of resonators; and rotating said plurality of dielectric resonators about the corresponding longitudinal axes in order to alter the strength of field coupling between said plurality of dielectric resonators.

2. The method of claim 1 wherein said bodies are cylindrical in shape.

3. The method of claim 1 wherein said bodies are elliptical in shape about said radial dimension.

4. A dielectric resonator circuit comprising:

an enclosure;

a plurality of dielectric resonators, each dielectric resonator comprising a body defining a longitudinal axis and a radial dimension orthogonal to said longitudinal axis, said bodies being non-uniform in the radial dimension and uniform in a direction of said longitudinal axis;

an input coupler; and an output coupler;

wherein said plurality of dielectric resonators are positioned relative to each other such that a field generated in each resonator couples to a field of another of said resonators and wherein said plurality of dielectric resonators are mounted to said enclosure such that the respective dielectric resonator is rotatable about the corresponding longitudinal axis.

5. The dielectric resonator circuit of claim 4 further comprising a plurality of posts mounted on said enclosure, each resonator rotatably mounted on a respective one of said posts so as to be rotatable about the corresponding longitudinal axis.

6. The dielectric resonator circuit of claim 4 wherein said bodies are cylindrical in shape.

* * * * *